US009182189B2

(12) United States Patent
Seigler

(10) Patent No.: US 9,182,189 B2
(45) Date of Patent: Nov. 10, 2015

(54) DRY FIRE PRACTICE TRAINING DEVICE

(71) Applicant: Stanley Hahn Seigler, Kamiah, ID (US)

(72) Inventor: Stanley Hahn Seigler, Kamiah, ID (US)

( * ) Notice: Subject to any disclaimer, the term of this patent is extended or adjusted under 35 U.S.C. 154(b) by 0 days.

(21) Appl. No.: 13/734,964

(22) Filed: Jan. 5, 2013

(65) Prior Publication Data

US 2014/0193778 A1 Jul. 10, 2014

(51) Int. Cl.
*F41A 33/00* (2006.01)
*F41A 19/00* (2006.01)
*F41A 9/64* (2006.01)

(52) U.S. Cl.
CPC . *F41A 33/00* (2013.01); *F41A 9/64* (2013.01); *F41A 19/00* (2013.01)

(58) Field of Classification Search
CPC ..... F41A 19/00
USPC ..... 434/16
See application file for complete search history.

(56) References Cited

U.S. PATENT DOCUMENTS 4,657,511 A 4/1987 Saunier
4,725,235 A 2/1988 Osborne
4,737,106 A 4/1988 Laciny
4,804,325 A 2/1989 Willits
5,451,162 A 9/1995 Parsons
5,993,215 A 11/1999 Kotsiopoulos
2011/0047847 A1* 3/2011 Hughes et al. ..... 42/1.01
2011/0306020 A1* 12/2011 Peterson ..... 434/18

OTHER PUBLICATIONS

"SIRT Training Pistol," GlockStore, https://www.youtube.com/watch?v=4zMv9syZY44, Aug. 23, 2010.*

* cited by examiner

*Primary Examiner* — Robert J Utama
*Assistant Examiner* — Jennifer L Fassett

(57) ABSTRACT

When a semi-automatic weapon is live fired, its firing pin is reset and is ready to be fired again. The shooter's hands remain in the firing position, and just the trigger finger and trigger are employed. But with dry fire practice, the shooter must remove a hand from the weapon and ratchet the slide to reset the firing pin, allowing the trigger to return to its unfired position. This must be done each time a shot is simulated. This invention provides, by incorporating a modified ammunition magazine in the weapon's magazine compartment, realistic muscle memory training by duplicating the action of the trigger, the feel and the sound of the release of the firing pin and the resetting of the trigger for additional trigger activations. It does not interact with the weapon's firing pin and does not require any alterations to the weapon such as disassembling and reassembling of parts.

10 Claims, 5 Drawing Sheets

DRY FIRE PRACTICE TRAINING DEVICE

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A SEQUENCE LISTING, A TABLE, OR A COMPUTER PROGRAM, LISTING COMPACT DISC APPENDIX

NOT APPLICABLE

BACKGROUND OF THE INVENTION

Live firing is the best way to practice drawing and firing a weapon. The practice process builds muscle memory, and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

Dry fire practice is a good substitute for live fire practice. Dry firing is another process of building muscle memory whereby a firearm, especially a pistol, is drawn, aimed, and fired without using live ammunition. This enables the practice of firing a weapon to proceed smoothly and accurately without all of the said negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in the home. With complete safety, actual shooting scenarios can be practiced in and around the home.

Practicing at the range can also be improved. When live fire is practiced at the range, the novice shooter usually has to spend a significant amount of time and expend a lot of ammunition getting accustomed to the report and recoil of the weapon. Before live practice begins, some dry fire practicing can be done. This gets the novice shooter accustomed to the trigger feel before having to deal with the recoil and the report of live firing.

A major negative factor occurs with most methods of dry firing because when a semi-automatic weapon is live fired, it resets its firing pin and is ready to be fired again until the magazine is empty. The shooter's hands remain in the firing position, and just the trigger finger and the trigger are employed. With normal dry fire practice, after the first activation of the trigger releasing the firing pin, the shooter must remove a hand from the weapon and ratchet the slide back in order to reset the firing pin. The shooter can then let the trigger return the to its unfired position. The weapon is then ready for another trigger activation. This must be done each time a shot is simulated. Doing this teaches improper muscle memory because it is not at all what happens during actual live fire.

Another negative for standard dry fire practice is that there is concern as to wear and tear on the constant releasing of a weapon's firing pin without it having the cushioning effect of the firing pin striking a round of ammunition.

There are some devices or systems that aid in dry fire practice, but none of the patented devices or systems address the "hands-free" trigger reset problem or the firing pin use problem.

Some patented training systems incorporate computer graphics into the training scenario. Other patents address the duplication of a weapon's recoil, laser marking of "shots", projecting images onto a screen, etc.

Here are a few examples of weapon training patents:

U.S. PATENT DOCUMENTS

| | | |
|---|---|---|
| 5,993,215; | Nov. 30, 1999 | Jansen; Kotsiopoulos |
| 4,657,511 | Apr. 14, 1987 | Allard; Briard; Saunier |
| 4,725,235 | Feb. 16, 1988 | Schroeder; Osborne |
| 4,737,106 | Apr. 12, 1988 | Laciny |
| 4,804,325 | Feb. 14, 1989 | Willits; Kleeman; Willits |
| 5,451,162 | Sep. 19, 1995 | Parsons |

Negative qualities of these devices or systems are that they are either user intensive and/or expensive to purchase, but most significantly they do not allow a shooter to use a fully functioning weapon that he may already own. There is also a learning curve or training necessary to use these systems, but most of all, none of the patented devices or systems address the "hands-free" trigger reset problem and the possible firing pin damage problem of normal dry fire practice.

There is therefore a need for a dry fire training device that uses a fully functioning weapon and allows for precise muscle memory training, is simple to operate, prevents the firing pin of the fully functioning weapon from being damaged, and provides for safe on-site home training. All references to this device are for use in a fully functioning weapon, not a practice weapon.

BRIEF SUMMARY OF THE INVENTION

The invention that is to be described accomplishes the most important aspects of dry fire training: no live ammunition is used providing safety and no on going expense, convenience of practicing in the home environment where the protective, fully functioning weapon would most likely be used, no involved disassembling and reassembling of any of the fully functional weapon's components, the realistic feel of the trigger during the firing process and the trigger reset, precise muscle memory training using only the trigger finger motion, and does not negatively affect the fully functional weapon's firing pin. This invention also helps the novice shooter train with his weapon before he has to deal with the recoil and the report of firing live ammunition. This invention is simple to use, provides realistic feel of the trigger operation, produces a sound that simulates the release of the weapon's firing pin, and does not require any alterations to the fully functional weapon such as disassembling and reassembling of any parts of the weapon. No previously patented device attempts to solve these problems of "hands-free" trigger reset or possible firing pin damage with a fully functional weapon. Neither do they address these problems of dry fire practice by addressing these situations through the weapon's magazine compartment. This invention simply slides into the magazine compartment in the weapon's handle, and practice can begin. It requires no alteration to the weapon before or after practice. This new device functions completely independent of the weapon's firing pin.

An additional point of safety is that the base plate, which is always visible to the shooter and trainer, is painted a bright orange color to identify the safety of device from a magazine that could contain live ammunition. There is no way that this device can mechanically accommodate any live ammunition.

DETAILED DESCRIPTION OF THE INVENTION

Figure 1:
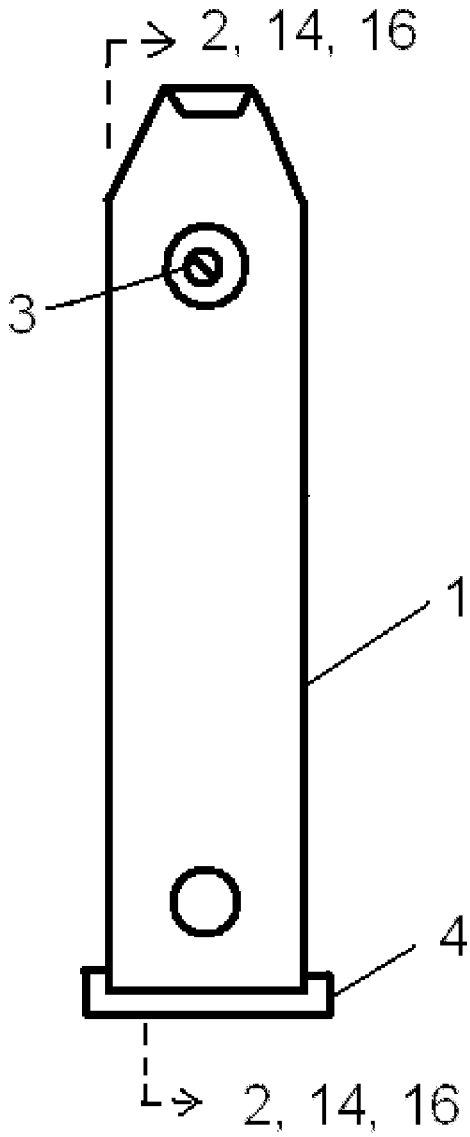
FIG. 1 illustrates a front view of an ammunition case with an adjusting nut and adjusting screw adhered to its front wall.
Figure 2:
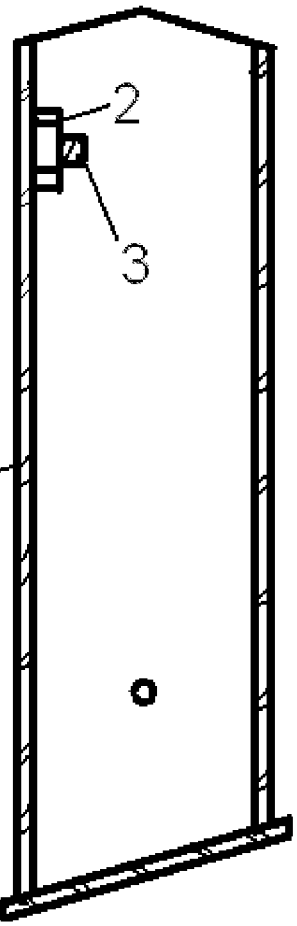
FIG. 2 illustrates a sectional side view of said ammunition case showing adjusting nut and adjusting screw adhered to its back wall.

FIGS. 1 & 2 illustrate an ammunition magazine case 1 that has been altered by two holes to receive the fulcrum pin 6, a third large hole to allow the sound from the detent reed 8 to be heard better, a fourth large hole to provide access to the detent regulating set screw 3 with its mounting nylon lock nut 2 adhered to the front internal wall of said magazine case 1. The slotted base plate 4 is shown at the lower end of the magazine case 1.

Figure 3:
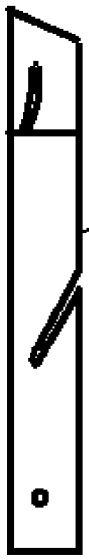
FIG. 3 illustrates a side view of the lever with various alterations.
Figure 4:
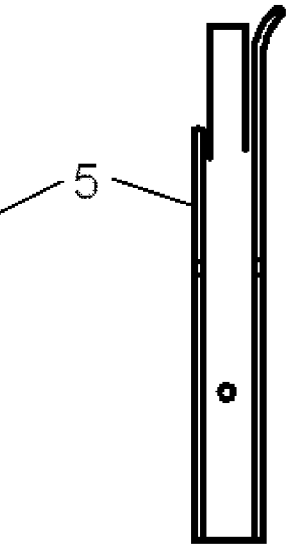
FIG. 4 illustrates a rear view of said lever with various alterations specifically illustrated is the upper right member which has been bent outward to intercept the weapon's trigger mechanism.
Figure 5:
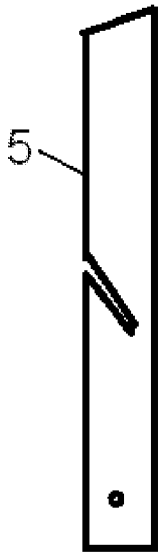
FIG. 5 illustrates a second side view of said lever with various alterations.

FIGS. 3, 4 & 5 illustrate the lever 5 with various cuts and bends to accept the fulcrum pin 6, the detent reed 8 with its mounting screw 9 and nut 10 and a platform for the compression spring 7.

FIG. 4 illustrates said lever 5 showing its upper most right member bent as necessary to intercept the fully functional weapon's trigger mechanism.

Figure 6:
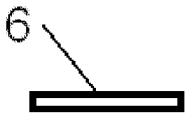
FIG. 6 illustrates the fulcrum pin.

FIG. 6 illustrates the fulcrum pin 6 that allows said lever 5 to rotate to activated said detent reed 8 by the action transferred through said lever 5, moving the detent reed 8 against the set screw 3, producing the tactile simulated release of the weapon's firing pin and producing the audible response simulating the release of the weapon's firing pin.

Figure 7:
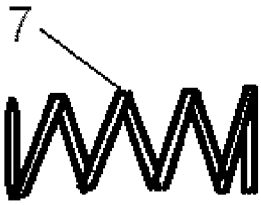
FIG. 7 illustrates the compression spring.

FIG. 7 illustrates the compression spring 7 that returns said lever 5 to its resting position and resets the weapon's trigger mechanism to its resting position.

Figure 8:
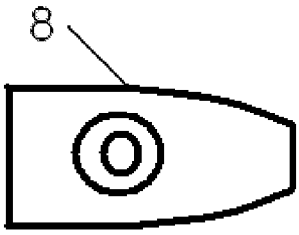
FIG. 8 illustrates the detent reed.

FIG. 8 illustrates the detent reed 8 that provides the tactile release simulating the feel of the release of the weapon's firing pin and the audible response simulating the sound of the release of the weapon's firing pin. The detent reed 8 may be doubled (not shown) to provide more tactile and auditory response.

Figures 9, 10, 11:
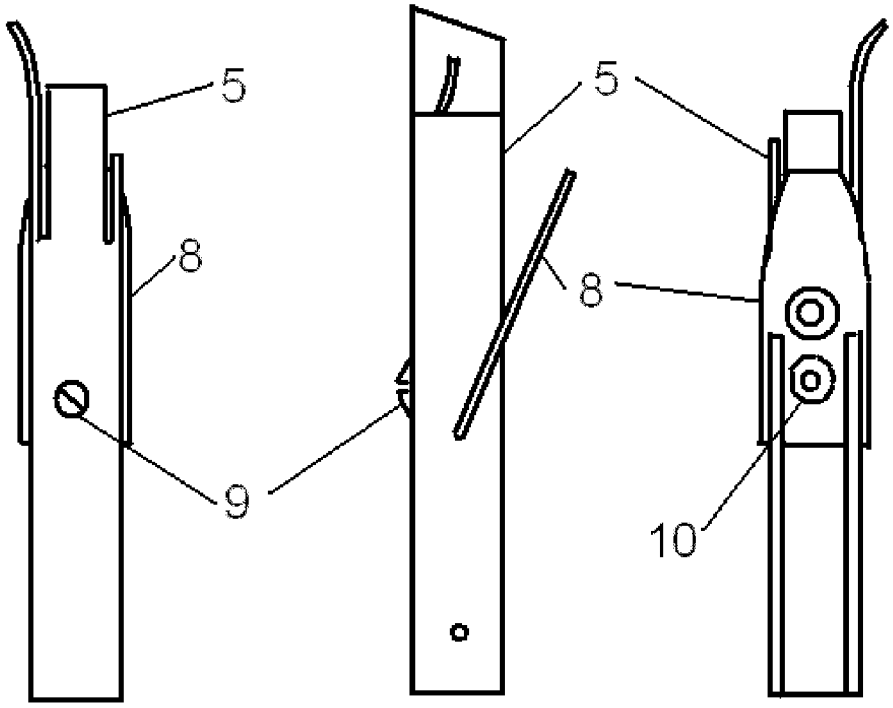
FIG. 9 illustrates a rear view of the lever with assembled detent reed.
FIG. 10 illustrates a side view of said lever with assembled detent reed.
FIG. 11 illustrates a front view of said lever with assembled detent reed.

FIGS. 9, 10 & 11 illustrate three views of the said lever 5 with the said detent reed 8 mounted with a machine screw 9 and lock nut 10 to hold said detent reed 8 in position.

Figure 12:
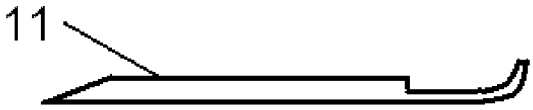
FIG. 12 illustrates a side view of the lifter.
Figure 13:
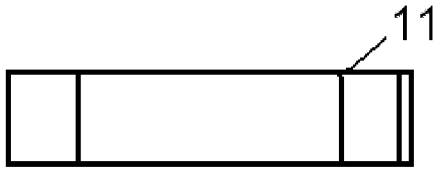
FIG. 13 illustrates a front view of said lifter.

FIGS. 12 & 13 illustrate a lifter 11 which has on one end an angled surface and on the other end a bent member. The said angled end intercepts the said lever 5 when the said bent member end is pushed by the shooter as the device is being inserted into the weapon's magazine compartment. The sliding action pushes lever 5 towards the back of the weapon far enough that lever 5 can freely move behind the weapon's trigger mechanism. The lifter 11 is then pulled back to its initial position so that the said lever 5 can interact with the weapon's trigger mechanism.

Figures 14, 15:
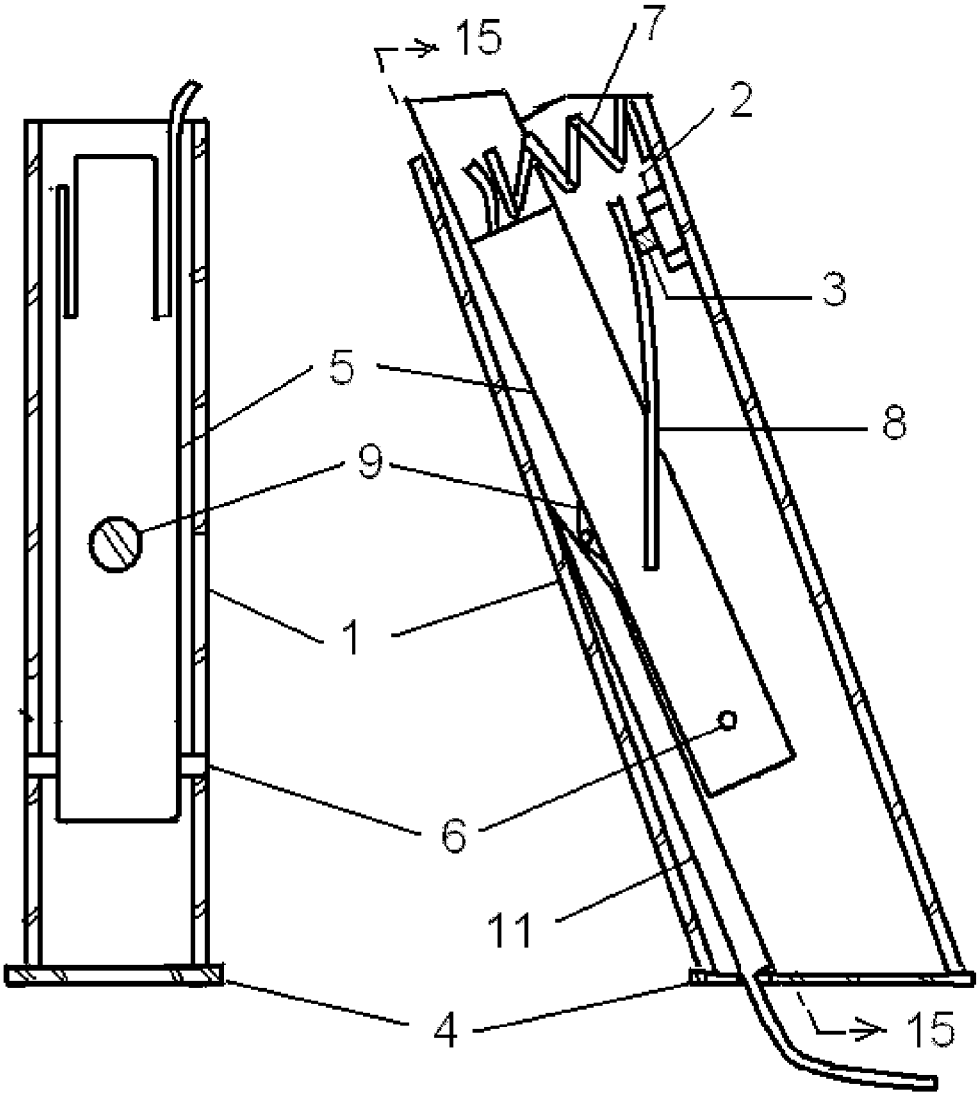
FIG. 14 illustrates a sectional side view of the assembled device in its resting position after being inserted into the weapon with said lifter in its retracted position.
FIG. 15 illustrates a rear sectional view of said assembled device.

FIG. 14 illustrates the assembled device providing a sectional view showing the said lever 5 in the resting position. The compression spring 7 is applying a forward force to hold the lever 5 forward. This view shows the detent reed 8 resting against the adjusting set screw 3 in its "untripped" or unreleased position. Said set screw 3 provides adjustment to control the release of the detent reed 8 at precisely the right position in the travel of the weapon's trigger. The lifter 11 is shown in its resting position. The slotted base plate 4 is shown at the lower end of the magazine case 1.

FIG. 15 illustrates a simplified sectional view showing the lever 5 (without the detent reed 8 and without compression spring 7 for simplification) with said lever's spring platform on its upper end illustrated in the center of the lever. The slotted base plate 4 is shown at the lower end of the magazine case 1.

Figure 16:
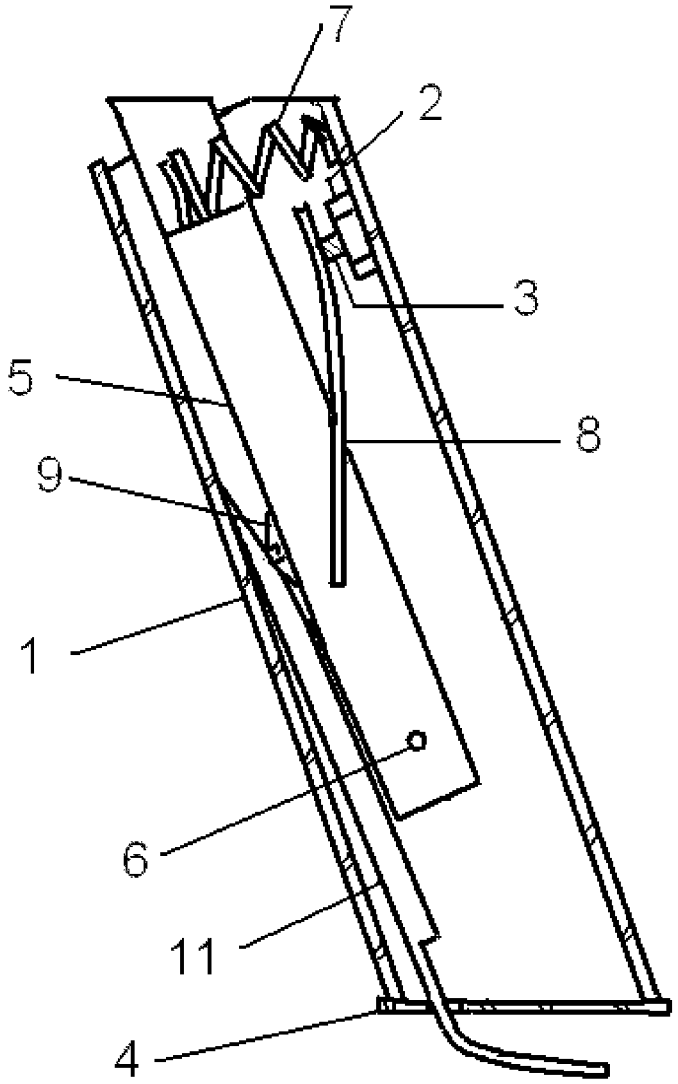
FIG. 16 illustrates a sectional side view of said assembled device with said lifter engaged.

FIG. 16 illustrates two situations:

I. The assembled device has been activated by the weapon's trigger mechanism at the upper end of lever 5. The lever 5 has been moved back, the compression spring 7 has been compressed between the lever 5 and the back of the magazine case 1, and the detent reed 8 has been moved through its activation point against the set screw 3 providing the tactile response and the audible response thus simulating the release of the weapon's firing pin. The slotted base plate 4 is shown at the lower end of the magazine case 1.

II. The assembled device has had its lifter 11 engaged so that the lever 5 has been moved back to allow the lever 5 to be positioned behind the weapon's trigger mechanism providing for ease of engagement into the weapon's magazine's compartment. After the lever 5 is in its working position, the shooter pulls the lifter 11 back to its resting position. If desired, a spring could be added to the device which would insure that the lifter 11 would return back to its resting position.

I claim:

1. A dry fire practice training device to be used in a fully functioning weapon, not a training pistol, that has an empty magazine compartment, said training device comprising a modified ammunition magazine, wherein said modified ammunition magazine comprises:

a lever providing a means for interaction between a trigger mechanism of the fully functioning weapon and two detent reeds;

a regulating assembly for regulating said detent reeds;

a compression spring providing a forward force to return said lever to its initial resting position;

a lifter positioning said lever behind the trigger mechanism of the fully functional weapon when the training device is inserted into the empty magazine compartment;

and an orange base plate for aligning the lifter and indicating that the fully functional weapon with the training device inserted into the empty magazine compartment is in a safe training mode; and whereby the dry fire practice training device provides realistic audible and tactile feedback during repetitive dry fire training.

2. The dry fire training device of claim 1, further comprising: a mechanical assembly for resetting the trigger mechanism of the fully functioning weapon for multiple activations to provide realistic, repetitive dry fire training.

3. The dry fire training device of claim 1, said modified ammunition magazine further comprising: first and second smaller holes to receive a fulcrum pin for the lever to rotate upon; a third hole, larger than the first and second smaller holes, to allow sound from the two detent reeds to be heard better by a shooter; and a fourth hole, larger than the first and second smaller holes, to provide access to the regulating assembly.

4. The dry fire training device of claim 1, said regulating assembly further comprising: a set screw in a nylon lock nut adhered to an inside back surface of said modified ammunition magazine which allows the two detent reeds to be adjusted to activate when the trigger mechanism of the fully functional weapon would release a firing pin of the fully functional weapon during normal live fire.

5. The dry fire training device of claim 1, wherein the lifter has an angled surface that provides an interaction between the lever and an inner front surface of the modified ammunition magazine to retract the lever toward a back surface of the modified ammunition magazine, far enough to position the lever behind the trigger mechanism of the fully functional weapon when the training device is inserted into the empty magazine compartment.

6. The dry fire training device of claim 1, wherein the lever is fabricated from a channel material of proper dimensions to support said two detent reeds and provide a platform for the compression spring.

7. The dry fire training device of claim 6, wherein the platform for the compression spring returns the lever to its initial resting position thereby resetting the trigger mechanism of the fully functional weapon for multiple activations, and wherein the lever further comprises: a slot to support said two detent reeds, providing audible and tactile simulation for repetitive trigger action; a hole for a machine screw and a nut to retain said two detent reeds in said slot; a hole for a fulcrum pin for said lever to rotate upon; and an elongated member that intercepts the trigger mechanism of the fully functional weapon.

8. The dry fire training device of claim 7, wherein the lever supports the compression spring between the platform for the compression spring of the lever and a back wall of the modified ammunition magazine, and when the compressed compression spring is released, the compression spring returns the lever to its initial resting position, thereby allowing for the immediate reset of the trigger mechanism of the fully functional weapon for multiple trigger activations or when the trigger mechanism is completely released, allowing the trigger to return to its unfired, resting position.

9. The dry fire training device of claim 1, wherein the lifter has an angled surface at one end and a bent projection at the other end which projects through the orange base plate and receives an upward force of a shooter's hand when the training device is inserted into the empty magazine compartment, thereby positioning the lever behind the trigger mechanism of the fully functional weapon.

10. The dry fire training device of claim 9, wherein the orange base plate further comprises a slot for aligning the bent projection to extend through said orange base plate to receive the upward force of the shooter's hand.

* * * * *